US006581518B2

(12) United States Patent
Deshefi et al.

(10) Patent No.: US 6,581,518 B2
(45) Date of Patent: Jun. 24, 2003

(54) DEVICE FOR HOLDING AND FEEDING A PRINTING PLATE TO A PRINTING CYLINDER OF A PRINTING MACHINE

(75) Inventors: Oskar Deshefi, Heidelberg (DE); Ivo Richter, Heidelberg (DE); Joachim Zarges, Mannheim/Friedrichsfeld (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/951,821

(22) Filed: Sep. 13, 2001

(65) Prior Publication Data

US 2002/0066384 A1 Jun. 6, 2002

(30) Foreign Application Priority Data

Sep. 13, 2000 (DE) ..... 100 45 231

(51) Int. Cl.[7] ..... B41F 27/06; B41L 47/14
(52) U.S. Cl. ..... 101/477; 101/415.1
(58) Field of Search ..... 101/477, 415.1, 101/216, 378, 382.1, 383, 479, 480, 485, 486

(56) References Cited

U.S. PATENT DOCUMENTS 5,511,478 A * 4/1996 Lindner et al. ..... 101/477
5,555,810 A * 9/1996 Stiel ..... 101/477
5,575,212 A * 11/1996 Moser et al. ..... 101/477

FOREIGN PATENT DOCUMENTS

EP 0 654 349 A1 5/1995
EP 0 655 330 A1 5/1995

* cited by examiner

*Primary Examiner*—Leslie J. Evanisko
(74) *Attorney, Agent, or Firm*—Laurence A. Greenberg; Werner H Stemer; Ralph E. Locher

(57) ABSTRACT

A device for holding and feeding a printing plate to a plate cylinder of a printing machine includes a holding device and a member having a supporting surface, the printing plate being disposable by one edge thereof on the supporting surface and being holdable in a predefinable alignment by the holding device, a mounting for movably supporting the holding device on the printing machine so that the holding device is movable from a rest position into a feeding position, a guide element having at least one guide surface, the guide element being movably mounted on the holding device and being movable from a rest position into a feeding position, the guide surface, in the feeding position, defining a feeding direction for feeding a printing plate to the plate cylinder, and a lever device via which the guide element is operatively connected to the printing machine, the guide element being movable automatically from the rest position into the feeding position by movement of the holding device.

10 Claims, 11 Drawing Sheets

DEVICE FOR HOLDING AND FEEDING A PRINTING PLATE TO A PRINTING CYLINDER OF A PRINTING MACHINE

BACKGROUND OF THE INVENTION

FIELD OF THE INVENTION

The invention relates to a device for holding and feeding a printing plate to a plate cylinder of a printing machine.

In printing machines, it has become known heretofore to provide a magazine for holding ready and changing a printing plate of a plate cylinder. The published European Patent Document EP 0 654 349 A1 discloses a device of the foregoing general type for holding and feeding a printing plate to a printing cylinder of a printing machine. The device described in this European patent document is provided with a holding device having a holding element and having a supporting surface, it being possible for a printing plate to be placed with one edge on the supporting surface and held by the holding element in a predefinable alignment on a side surface of the printing plate. In this way, a printing plate can be kept ready for a quick change in a printing machine.

The holding device is arranged parallel to the plate cylinder and constructed so that it is movable in vertical direction. The holding device can be moved from a lower rest position into an upper feeding position. Also provided is a guide element, which has at least one guide surface, the guide element being movably mounted and having the ability to be moved from a rest position into a feeding position. In the feeding position, the guide surface defines a feeding direction for feeding the printing plate to the plate cylinder. The guide element is mounted so as to be rotatable about an axis of rotation and is connected to a pneumatic cylinder via a mounting. If the holding device is moved upwardly into the feeding position, the pneumatic cylinder then pivots the guide surface in the predefined feeding direction, so that a printing plate placed on the supporting surface can be pushed along the guide surface into a holding device belonging to the plate cylinder.

The heretoforeknown device is relatively complicated, as the result of the use of a pneumatic cylinder, and is expensive to produce.

SUMMARY OF THE INVENTION

It is accordingly an object of the invention to provide a simplified and cost-effective device for holding and feeding a printing plate to a plate cylinder of a printing machine.

With the foregoing and other objects of the invention, there is provided, in accordance with the invention, a device for holding and feeding a printing plate to a plate cylinder of a printing machine, comprising a holding device and a member having a supporting surface, the printing plate being placeable or disposable by one edge thereof on the supporting surface and being holdable in a predefinable alignment by the holding device, a mounting for movably supporting the holding device on the printing machine so that the holding device is movable from a rest position into a feeding position, a guide element having at least one guide surface, the guide element being movably mounted on the holding device and being movable from a rest position into a feeding position, the guide surface, in the feeding position, defining a feeding direction for feeding a printing plate to the plate cylinder, and a lever device via which the guide element is operatively connected to the printing machine, the guide element being movable automatically from the rest position into the feeding position by movement of the holding device.

In accordance with another feature of the invention, the guide element has two guide surfaces defining a holding space for a printing plate therebetween, the guide element having an axis of rotation disposed at least approximately parallel to an axis of rotation of the plate cylinder, the guide element being rotatable so that an end region of a respective printing plate disposed in the holding space is bent in the feeding direction.

In accordance with a further feature of the invention, the lever device is a roller with a lever arm, the roller being operatively connected to the guide element via the lever arm, the roller being rollable on a rolling surface from the rest position into an operating position during the movement of the holding device, the rolling surface being formed so that the guide element is movable by the roller into the feeding position, via the lever arm, as the roller rolls from the rest position into the operating position.

In accordance with an added feature of the invention, the rolling surface is an inclined plane with a defined angle of inclination.

In accordance with an alternative feature of the invention, the lever device is constructed as a driver arm and a triggering pin, the driver arm being mounted so as to rotate about an axis of rotation on the holding device, and the triggering pin being formed on the printing machine, the driver arm being operatively connected to the guide element, and the driver arm and the triggering pin being arranged so that, during the movement of the holding device from the rest position into the feeding position, the driver arm is rotated by the triggering pin into the feeding position, the guide element being also rotated into the feeding position, and the driver arm being rotated into the rest position by the triggering pin during the movement of the holding device from the feeding position into the rest position, the guide element also being rotated into the rest position.

In accordance with an additional feature of the invention, the supporting surface is formed in a rotatably mounted holding bracket, and there is included a stop element formed on the guide element, the holding bracket being biased against the stop element, the stop element, in the rest position of the guide element, holding the holding bracket in an operating position wherein the supporting surface blocks the feeding direction, and in the feeding position of the guide element, the stop element releasing the holding bracket, and the holding bracket being moved into an operating position, wherein the supporting surface clears the feeding direction.

In accordance with yet another feature of the invention, the supporting surface has an edge elevatable in the direction of the holding space, the edge, during a transition of the holding bracket from the rest position into the operating position, being bringable into contact with a printing plate disposed on the supporting surface, so that the printing plate remains standing on the supporting surface and is not released.

In accordance with yet a further feature of the invention, the guide surface is an inner guide surface having an upper region inclined in a direction of a second guide surface up to a bending edge.

In accordance with yet an added feature of the invention, the bending edge is formed as a rotatably mounted roller.

In accordance with a concomitant feature of the invention, the guide surface is an outer guide surface formed by rotatably mounted rollers arranged in one plane.

An advantage of the invention is that the guide element is operatively connected to the printing machine via a lever device, so that the guide element is automatically rotated from the rest position into the feeding position by the movement of the holding device. In this way, the use of a pneumatic cylinder is avoided, so that the holding and feeding device according to the invention is less expensive to produce, and no additional control for a pneumatic cylinder is needed.

The guide element preferably has two guide surfaces, a holding space for a printing plate being defined between the guide surfaces. In addition, the guide element is mounted so that it can be rotated about an axis of rotation, the axis of rotation being arranged at least approximately parallel to the alignment of the guide surfaces. The mounting for the guide element is preferably constructed so that an end region of a printing plate, which is arranged in the holding space, is bent over the first and the second guide surface in the predefined feeding direction.

A result thereof is that only the end region of the printing plate is bent in the predefined feeding direction, so that the remaining part of the printing plate is held in the predefined holding position. A compact and narrow construction of the guide element is therefore possible, so that the guide element has a low mass and, therefore, is easy to operate.

A preferred embodiment of the lever device calls for the use of a roller which rolls over a rolling surface, the rolling surface being formed in such a manner that the roller, as it rolls, moves the guide element from the rest position into the feeding position via a lever. The use of a roller with a rolling surface is a simple and cost-effective principle in order to execute a rotation of the guide element as a function of the movement of the holding element.

In a preferred embodiment, the rolling surface is formed by an inclined plane with a defined angle of inclination to the direction of motion of the holding device.

A further embodiment of the lever device calls for a lever arm which interacts with a triggering pin. The triggering pin is arranged on the frame of the printing machine. The lever arm is rotatably mounted on the holding device and is operatively connected to the guide element. During the movement of the holding device from the rest position into the feeding position, the lever arm is moved past the triggering pin and rotated by the triggering pin into an operating position. As a result of the rotation of the lever arm into the operating position, the guide element is simultaneously rotated from the rest position into the feeding position via the operative connection. If the holding device is moved back again into the rest position from the feeding position, then the lever arm is again rotated into the rest position by the triggering pin, the guide element also being rotated back into the rest position from the feeding position. The use of a rotatably mounted lever arm interacting with a triggering pin constitutes a simple principle with which an adequate torque is provided to rotate the guide element into the feeding position and back into the rest position.

In a preferred embodiment, the supporting surface is formed by a holding bracket, which is biased against a stop so that the supporting surface is urged to clear the feeding direction. In addition, the holding bracket is mounted on the holding device, so that during rotation of the guide element from the rest position into the feeding position, the stop element is rotated away by the holding bracket, and the supporting surface clears the feeding direction.

In a special embodiment, an edge elevated in the direction of the holding space is formed on the supporting surface and, during the transition of the holding bracket from the rest position into the operating position, is bringable into contact with a printing plate standing on the supporting surface, so that the supporting surface does not clear the feeding direction during the movement of the holding device into the feeding position. only by lifting the printing plate over the edge outwardly does the movement of the supporting surface completely out of the feeding direction result because of the bias on the holding bracket, and the printing plate is able to be pushed in the predefined feeding direction into a holding device belonging to the printing cylinder.

In a preferred embodiment, the guide surface, which is arranged between the holding space and the printing machine, has a defined bending edge, with which a printing plate inserted into the holding space is bent at a defined, fixed bending line as the guide element is pivoted into the feeding position. In an advantageous embodiment, the bending edge is formed by a rotatably mounted roller, which reduces the friction occurring as the printing plate is inserted between the printing plate and the inner guide surface in the direction of the plate cylinder.

In a further preferred embodiment, the outer guide surface, which is arranged opposite the inner guide surface, is formed by one or preferably several rotatably mounted rollers. The rollers are preferably aligned perpendicularly to the feeding direction of the printing plate.

Other features which are considered as characteristic for the invention are set forth in the appended claims.

Although the invention is illustrated and described herein as embodied in a device for holding and feeding a printing plate to a plate cylinder of a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, which:

DESCRIPTION OF THE PREFERRED EMBODIMENTS

Figure 1:
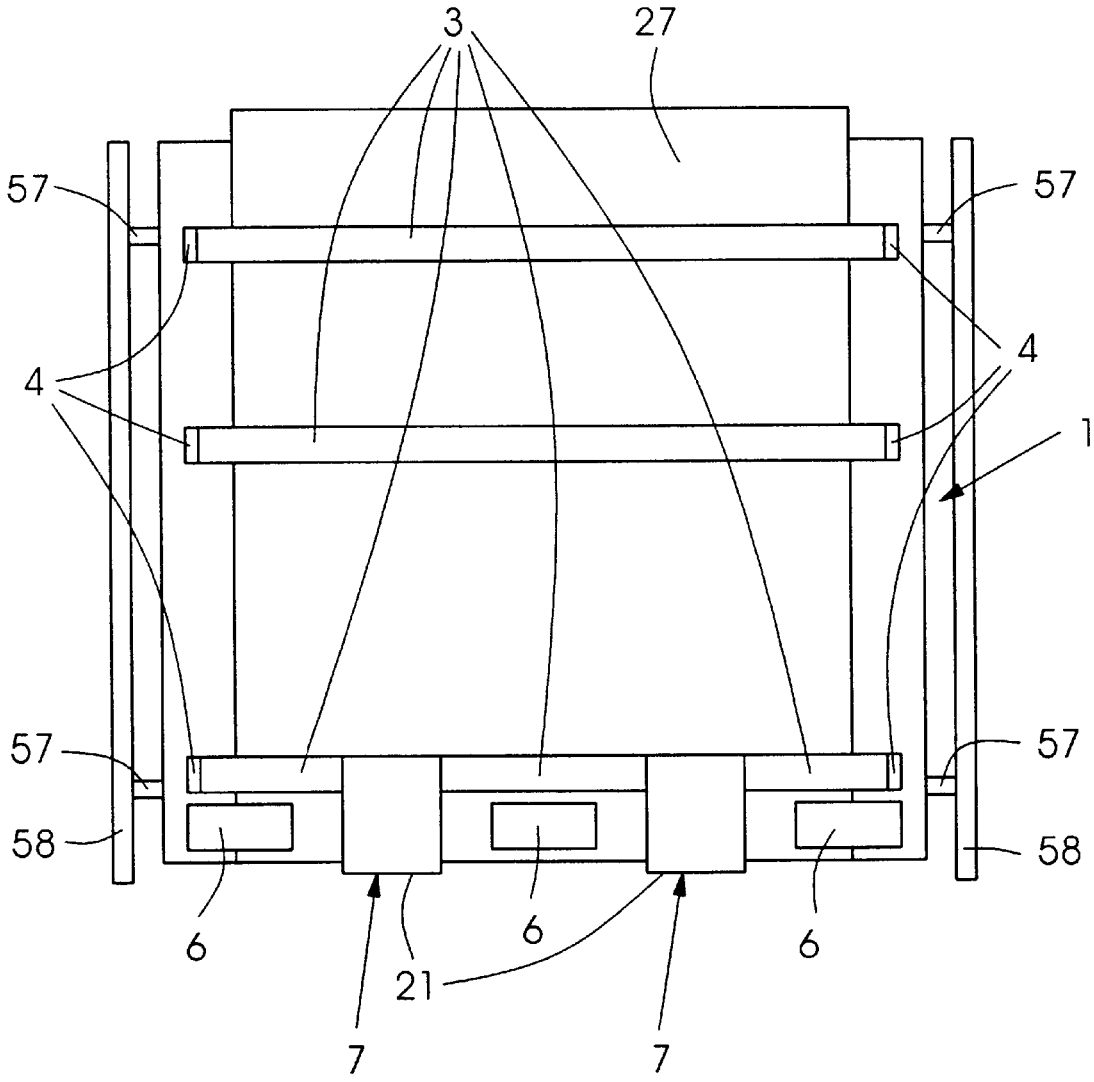
FIG. 1 is a front elevational view of a protective grille of a printing machine.

Referring now to the drawings and, first, particularly to FIG. 1 thereof, there is shown therein, in a front elevational view, a printing machine having a protective grille 1, which, in a lower region thereof, has guiding devices 6 and holding brackets 7. Between the protective grille 1 and first guide rollers 3, a printing plate 27 has been inserted and is resting with a lower edge thereof on a supporting surface 21 of the holding brackets 7.

The protective grille 1 is mounted so as to be movable vertically in two side parts 58 of the printing machine, with guide pins 57 formed on both side edges thereof. The side parts 58 are incorporated in the frame of the printing machine. In FIG. 1, the protective grille 1 is illustrated in a lower position thereof, a so-called rest position. The protective grille 1 has, on both side edges thereof, spacers 4 which are distributed uniformly over the entire height thereof, and having the first guide rollers 3, respectively, fixed at the ends thereof, the first guide rollers 3, respectively, being rotatably mounted. The first guide rollers 3 are arranged above one another, at least approximately horizontally, and lie on a line defining an acute angle with the protective grille 1 (note FIG. 2). Underneath the lowermost first guide roller 3, a holding plate 5 is formed on the protective grille 1 (note FIG. 2), the guiding device 6 being fixed to the holding plate 5 and mounted so that it is rotatable via two lever arms 13 and 14 (note FIG. 3). In addition, holding brackets 7 are rotatably mounted on the lowermost first guide roller 3, as viewed in FIG. 2. The printing plate 27 rests on the first guide rollers 3 and, because of the arrangement of the first guide rollers 3, is disposed close to the printing machine and, therefore, accommodated in a space-saving manner.

Figure 2:
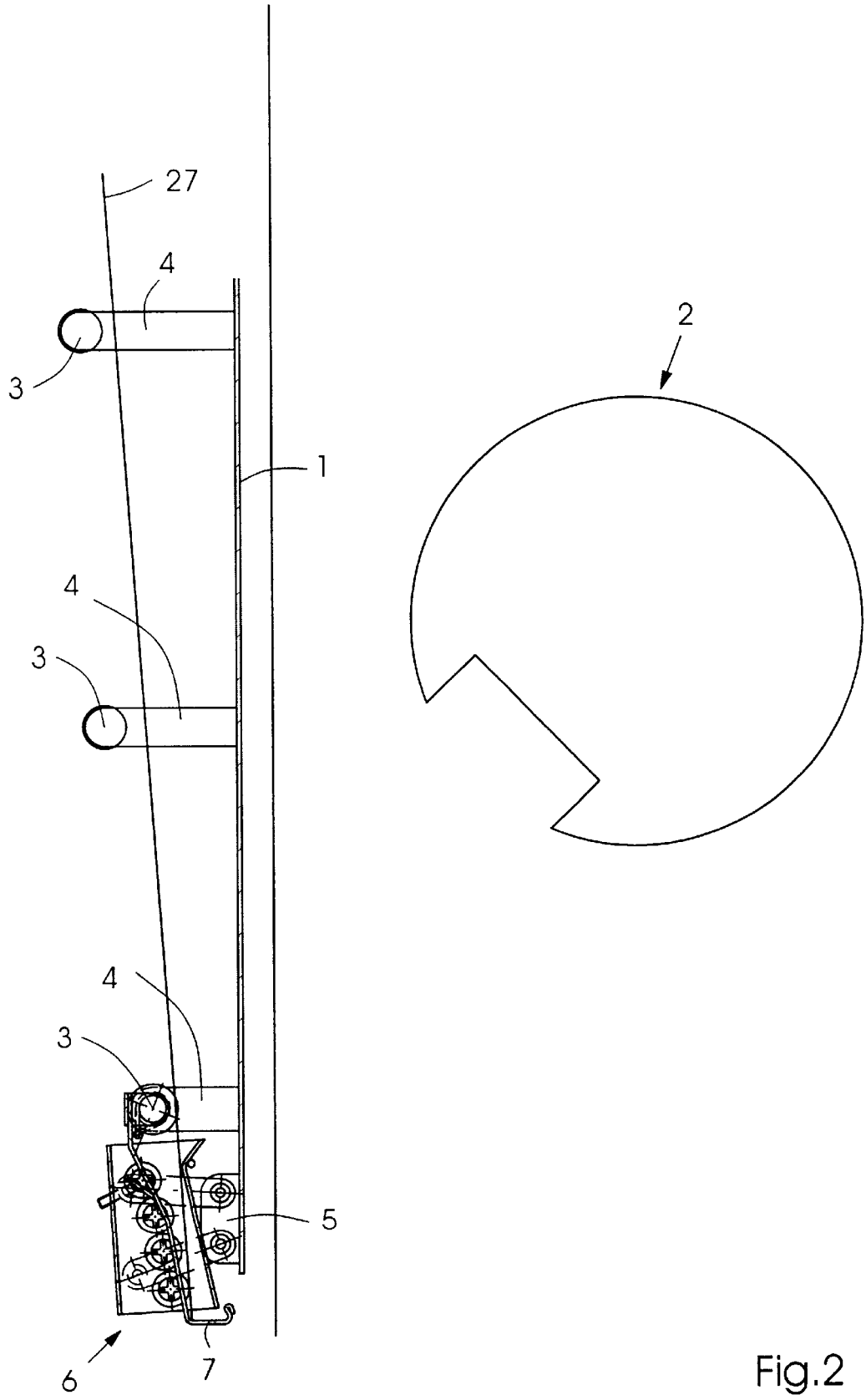
FIG. 2 is a diagrammatic vertical sectional view of a device for holding and feeding a printing plate according to the invention, and a printing cylinder to which the printing plate is fed.

FIG. 2 is a fragmentary diagrammatic vertical sectional view of FIG. 1 showing part of the printing machine. In the interest of clarity, other parts of the printing machine, which have no effect upon the holding and feeding device according to the invention, are not illustrated.

A diagrammatic side elevational view of the device according to FIG. 1 is illustrated, and a plate cylinder 2 is also shown in FIG. 2. The position of the printing plate 27 in the guiding device 6 and on the holding bracket 7 can be seen quite clearly.

Figure 3:
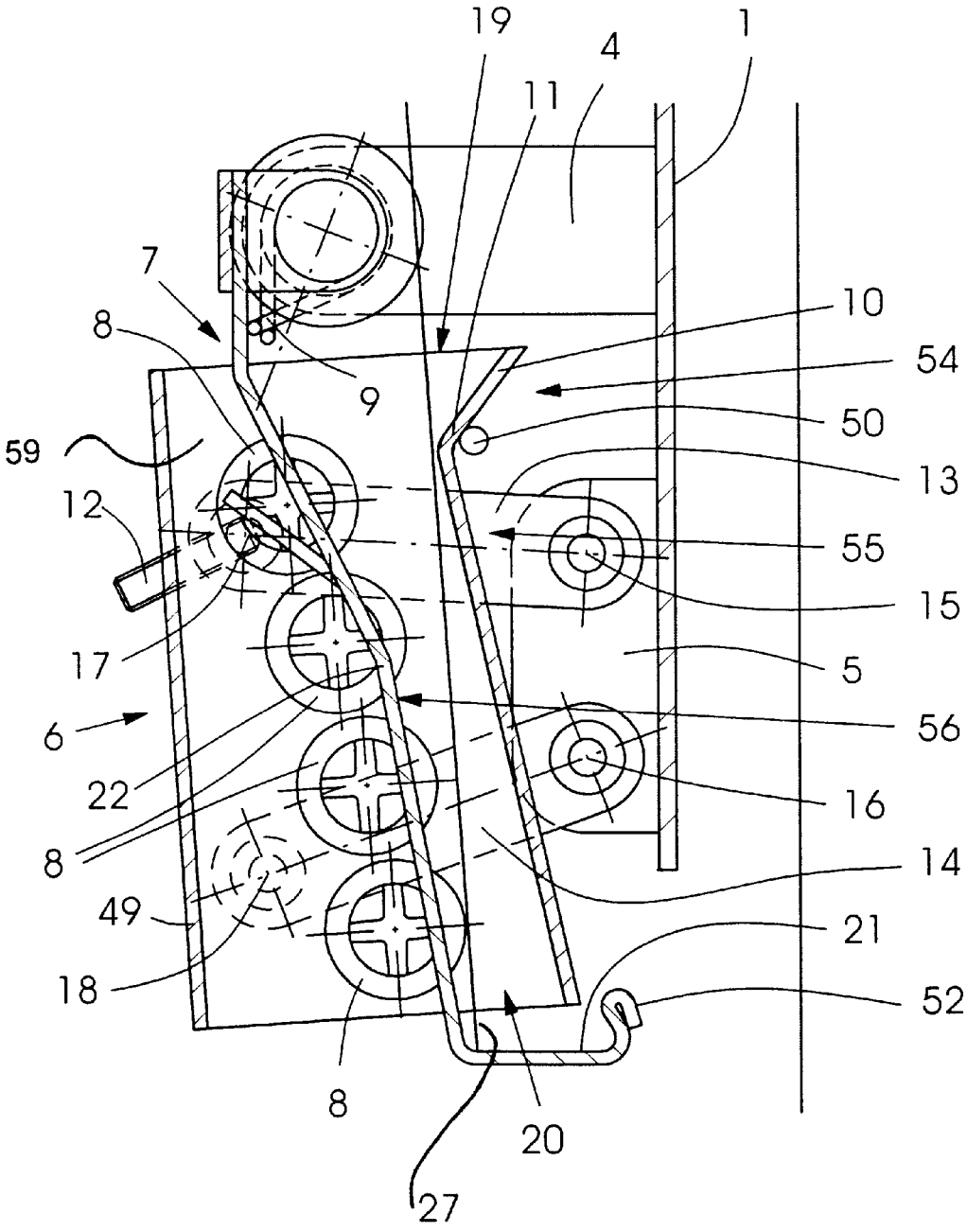
FIG. 3 is an enlarged view of the guide device in a rest position thereof.

FIG. 3 is an enlarged fragmentary, side elevational view of the guiding device 6, which has a guide plate 10, which is arranged parallel to the axis of rotation of the plate cylinder 2. Via two non-illustrated side parts, the guide plate 10 is connected to an outer plate 49, an insertion opening 19 being formed in an upper region between the guide plate 10 and the outer plate 49, and an ejection opening 20 formed therebetween in a lower region. Arranged between the guide plate 10 and the outer plate 49 are second guide rollers 8, which are arranged at least approximately parallel to the axis of rotation of the plate cylinder 2 and, at the sides, are mounted in the side parts of the guiding device 6. Formed between the second guide rollers 8 and the guide plate 10 is a holding space for holding a printing plate 27.

In a preferred embodiment, the guide plate 10, in an upper region 54 starting from the upper edge and extending in the direction of the second guide rollers 8, is arranged at an angle as far as a bending edge 11, the guide plate 10 being arranged at an angle extending away from the second guide rollers 8 in a lower region 55, starting from the bending edge 11. The bending edge 11 is preferably formed parallel to the axis of rotation of the plate cylinder 2. In a preferred embodiment, the bending edge 11 is represented by a roller 50. The roller 50 is rotatably mounted, so that friction, which is produced when the printing plate 27 rests on the roller 50, is largely reduced.

The inclined alignment of the upper region 54 in the direction of the bending edge 11 offers the advantage that a printing plate 27 can be inserted into a relatively wide insertion opening 19 and, during further insertion through the upper region 54, is deflected in the direction of the second guide rollers 8.

The second guide rollers 8 are arranged above one another on a predefined axis and define a second guide surface for the printing plate 27.

Arranged above the guiding device 6, on the protective grille 1, is a spacer 4, which extends beyond the insertion opening 19. At the end of the spacer 4, the holding bracket 7 is rotatably mounted. The holding bracket 7 extends with a holding arm 56 as far as the ejection opening 20 and, in the region of the ejection opening 20, has a supporting surface 21 which, in the rest position of the holding bracket 7, is formed so as to be approximately perpendicular to the insertion direction of the printing plate 27. In this regard, the supporting surface 21 is oriented in the direction of the protective grille 1; in a preferred embodiment, the supporting surface 21 is closed off by an edge 52 which is bent upwardly.

Fixed to the outer plate 49 via a screwthread is an adjustable stop element 12, which is formed so as to be displaceable in the direction of or towards a holding space 59 and the holding bracket 7. The stop element 12 projects to such an extent into the holding space 59 that the holding arm 56 rests on the stop element 12 and, as a result, the position of the holding bracket 7 is fixed so that a printing plate 27 inserted into the holding space 59 comes to rest with the leading edge thereof on the supporting surface 21 and is held in this position by the holding bracket 7. The holding bracket 7 is biased in the direction of the stop element 12 by a tension spring 9, which is restrained on the spacer 4.

Underneath the lowermost spacer 4, as viewed in FIGS. 2 and 3, for example, the protective grille 1 has the holding plate 5, whereon a first lever arm 13 is rotatably mounted on a first pivot 15. The first lever arm 13 is rotatably mounted with a side face of the guiding device 6 on a third pivot 17. Formed on the holding plate 5, underneath the first pivot 15, is a second pivot 16, via which a second lever arm 14 is rotatably mounted on the holding plate 5. The second lever arm 14 is rotatably mounted with a side part of the guiding device 6 on a fourth pivot 18. In this way, the guiding device 6 is held on the protective grille 1 so that the guiding device 6 can pivot in a predefined travel curve. Both side parts of the guiding device 6 are preferably mounted on corresponding holding plates 5, respectively, via corresponding first and second lever arms 13 and 14.

Figure 4:
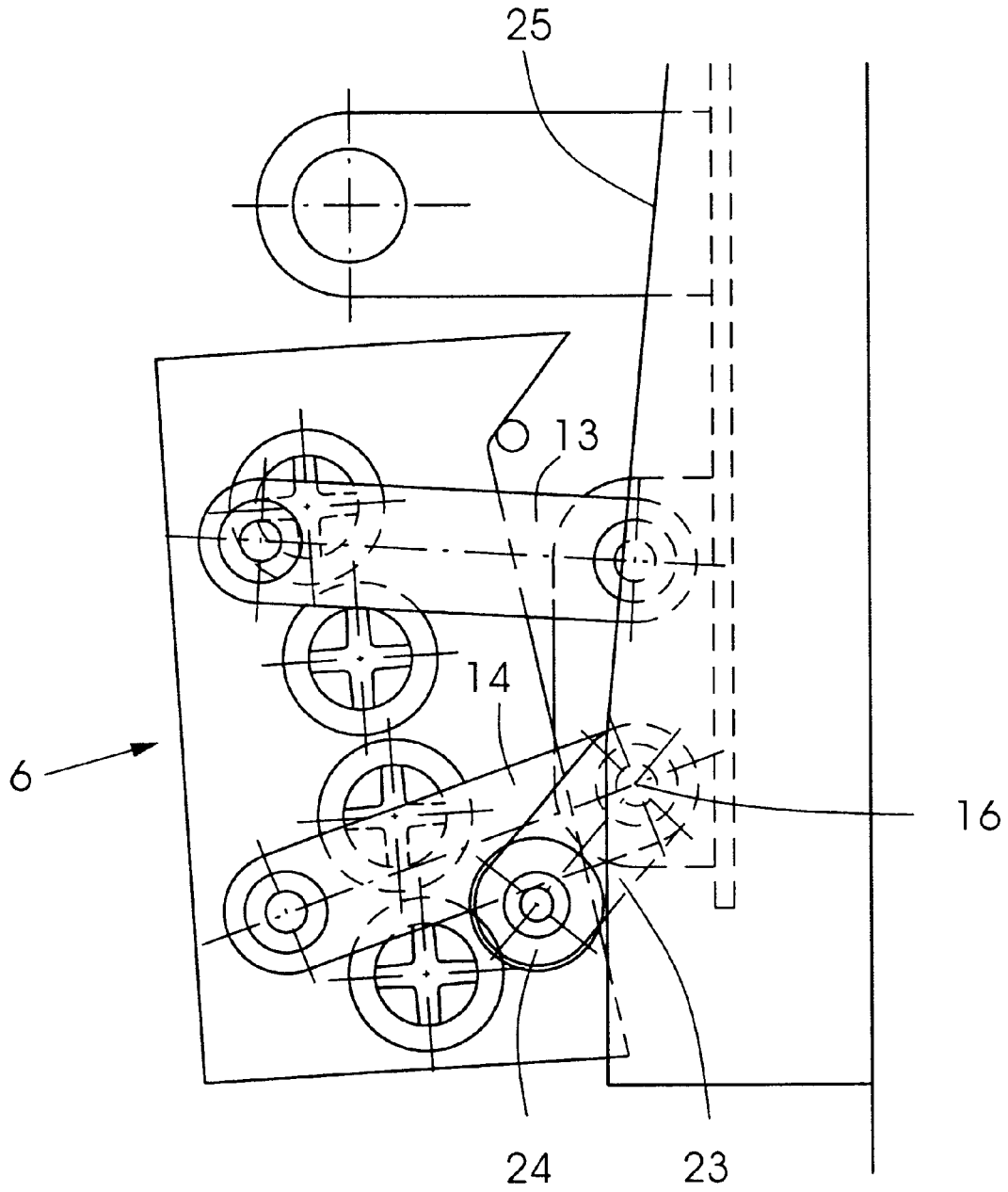
FIG. 4 is a view similar to that of FIG. 3, showing the guide device in the rest position thereof, with a roller and a rolling surface.

FIG. 4 shows the guiding device 6 of FIG. 3, a roller 24 being added, which is mounted on the second pivot 16 via a third lever arm 23 and is firmly connected to the second lever arm 14. The roller 24 is assigned to a rolling surface 25, which is formed on the frame of the printing machine. The axis of rotation of the roller 24 is arranged perpendicularly to the direction of motion of the protective grille 1. The rolling surface 25 is disposed at an acute angle to the direction of motion of the protective grille 1. FIG. 4 shows the guiding device 6 in the rest potion corresponding to that of FIG. 3, the roller 24 being disposed in a lower end region of the rolling surface 25 and being spaced relatively distal or far away from the protective grille 1. The roller 24, by the position thereof, defines the position of the guiding device 6. If the protective grille 1 is moved upwardly into a feeding position, the roller 24 then rolls along on the rolling surface 25, accordingly, and, because of the inclination of the rolling surface 25, approaches the protective grille 1, so that the lever 14 is pivoted downwardly about the second pivot 16. In this regard, the guiding device 6 is guided on the predefined pivoting curve by the first lever arm 13 and is moved into a feeding position.

Figure 5:
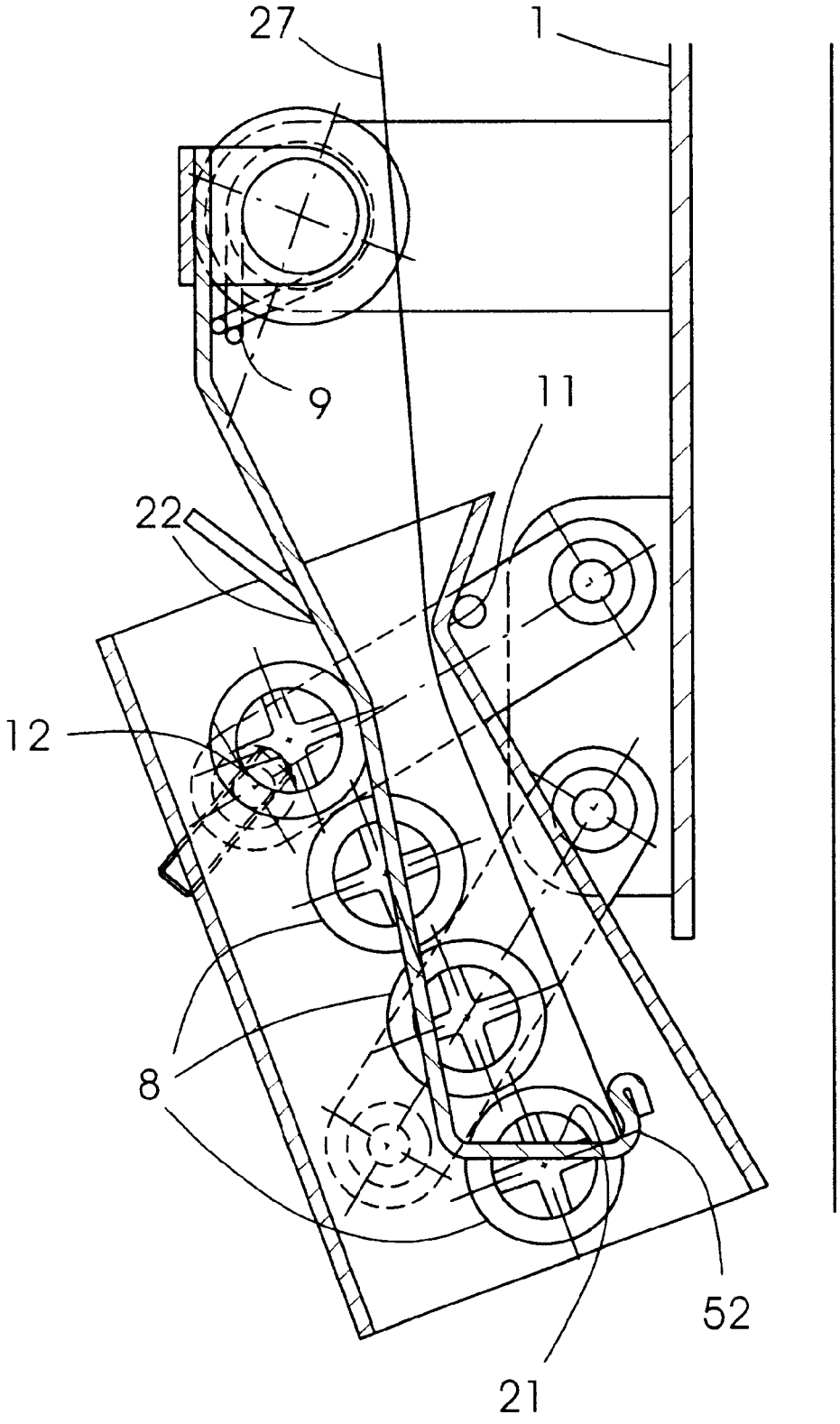
FIG. 5 is a view similar to that of FIG. 3, showing the guide device in the feeding position thereof, with the printing plate firmly held.

FIG. 5 shows the guiding device 6 with the protective grille 1 in the upper feeding position. Accordingly, because of the changed position of the roller 24, the guiding device 6 has been pivoted into the feeding position. In this regard, the stop element 12 which, in the rest position thereof, rests on the stop surface 22 on the holding arm 56, releases the holding bracket 7. As a consequence, the holding bracket 7 is moved by the tensioned spring 9 in the direction of the outer plate 49, so that the lower edge of the printing plate 27 is released in the region of the ejection opening 20. In this regard, the printing plate 27 must be held firmly by an operator so that the printing plate 27 does not fall into the printing machine in the direction of the plate cylinder 2. In an improved embodiment, the holding bracket 7 has the edge 52 at the front end of the supporting surface 21, so that, as illustrated in FIG. 5, the lower edge of the printing plate 27 is brought into contact with the edge 52. In this embodiment, the printing plate 27 continues to be held by the holding bracket 7, although the stop element 12 has released the movement of the holding bracket 7. The guiding device 6 is therefore located in a feeding position, wherein the guide plate 10 with the bending edge 11 is brought into contact with the printing plate 27. At the same time, the printing plate 27, in a region of the lower edge thereof, rests on a second guide roller 8 and is bent in the direction of a predefined feeding direction. The lower region of the printing plate 27 is therefore aligned in the predefined feeding direction.

In a simple embodiment, instead of the second guide roller 8, a second guide surface in the form of a plate is formed, which permits the printing plate 27 to be limited and aligned in the predefined feeding direction.

Figure 6:
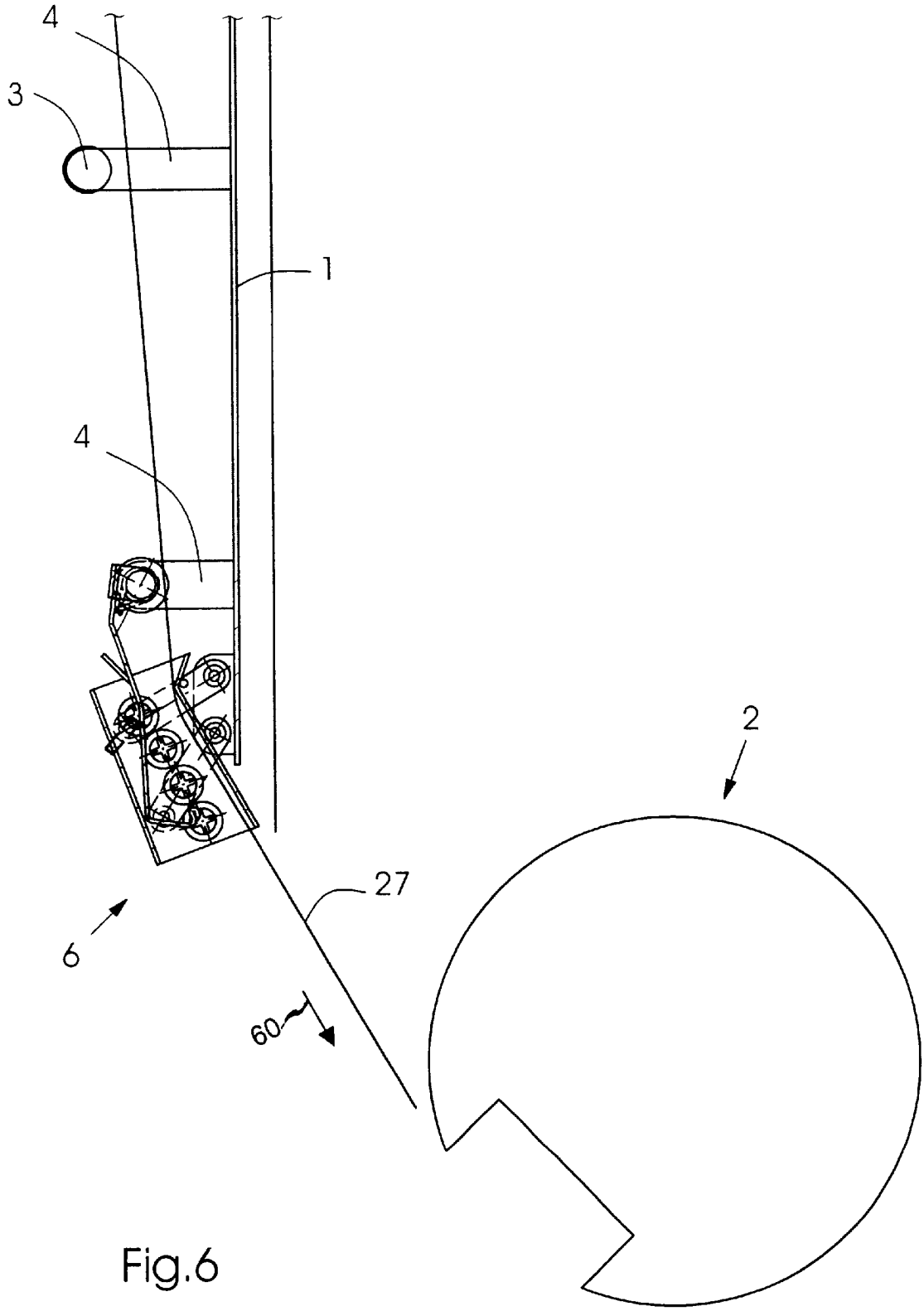
FIG. 6 is a view similar to that of FIG. 2, showing the holding device with the guide device, and a plate cylinder.

FIG. 6 shows the plate cylinder 2 and the guiding device 6 with the protective grille 1. The protective grille 1 is in the upper feeding position, following a brief lifting of the printing plate 27, during which the holding bracket 7 pivots in the direction of the outer plate 49 and therefore releases the lower edge of the printing plate 27 for a feeding operation in the direction of the plate cylinder 2. The printing plate 27 has been inserted a short distance in the direction of the printing cylinder 2. In this case, it can clearly be seen that the printing plate 27, as it is pushed through the guiding device 6, is aligned by the bending edge 11 and the second guide rollers 8 from an insertion direction in the holding space 59 into the predefined feeding direction to be fed to the plate cylinder 2. The feeding direction is represented by an arrow 60 in FIG. 6. In order to mount the printing plate 27 on the plate cylinder 2, the printing plate 27 is pushed towards the plate cylinder 2 and fixed to the plate cylinder 2 by a suitable non-illustrated holder. Following appropriate rotation of the plate cylinder 1, the second end edge of the printing plate 27 is also fixed to the plate cylinder 2 by a second holder. The printing plate 27 is consequently tautened or clamped onto the plate cylinder 2, and a printing operation can begin.

Figure 7:
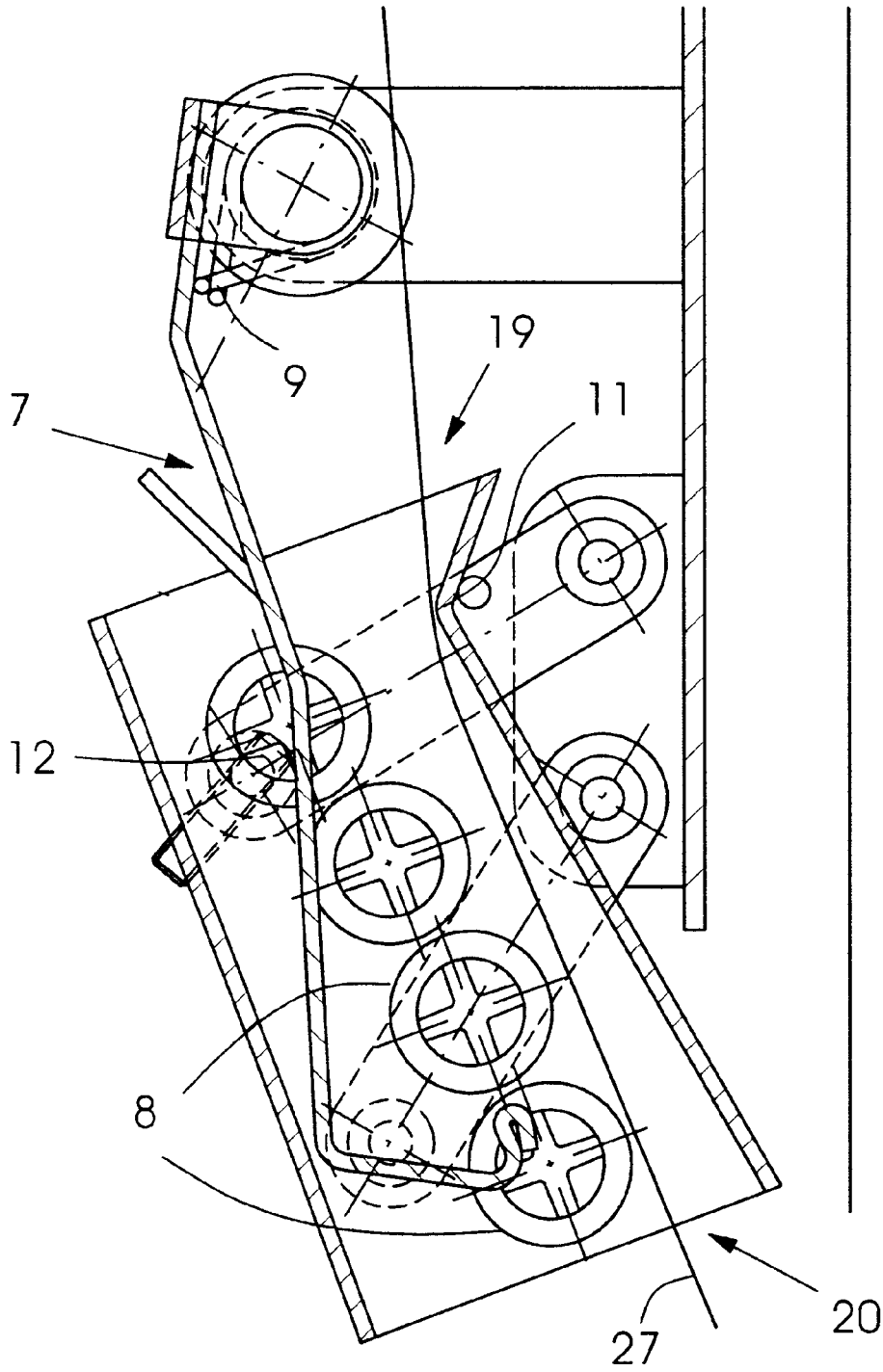
FIG. 7 is a view similar to that of FIG. 5, showing the guide device in the feeding position thereof.

FIG. 7 presents an enlarged view showing, in greater detail, the guiding device 6 in the feeding position of FIG. 6, wherein the holding bracket 7 has been deflected out as far as the stop element 12, and the ejection opening 20 has been released completely. Further shown is a printing plate 27, which has been guided through the insertion opening 19, via contact with the bending edge 11 and two second guide rollers 8 through the ejection opening 20 in the predefined feeding direction. In the interest of clarity, the roller 24 with the third lever arm 23 is not shown in FIG. 7.

Figure 8:
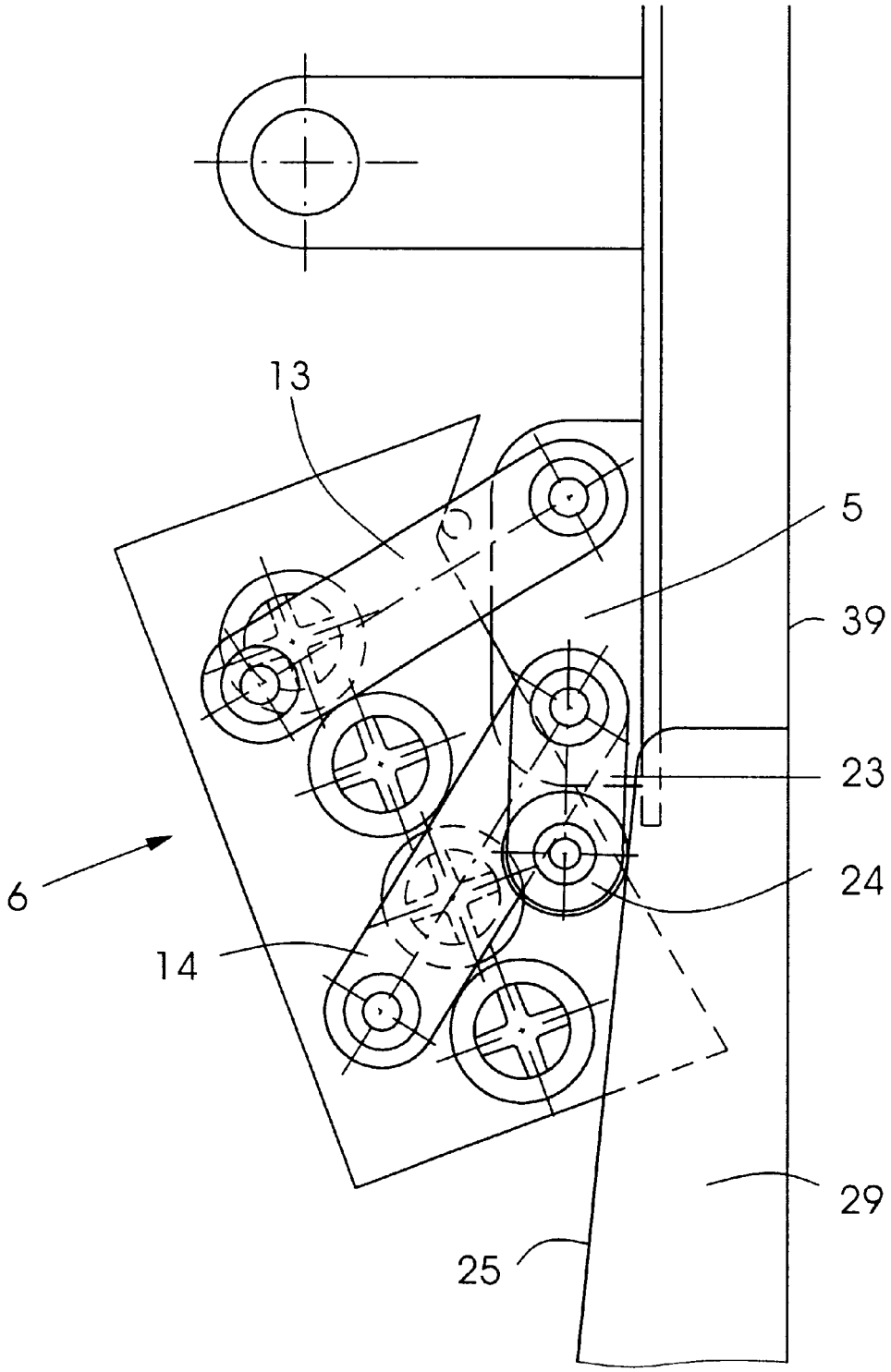
FIG. 8 is a view similar to that of FIG. 4, showing the guide device in the feeding position thereof, with a roller and rolling surface.

FIG. 8 shows the guiding device 6 in the feeding position corresponding to that of FIGS. 6 and 7 but, in this view, the roller 24, the third lever arm 23 and the rolling surface 25 are illustrated. In the feeding position, the protective grille 1 is in an upper position, wherein the roller 24 is located in an upper end region of the rolling surface 25. The rolling surface 25 is inclined upwardly in the direction of the printing machine, so that, in the upper position corresponding to that of FIG. 7, the roller 24 is arranged closer to the printing machine and, by the lever action via the third lever arm 23 and the second lever arm 14, the guiding device 6 has been pivoted into the feeding position. The rolling surface 25 is formed on a spacer block 29, which is connected to a frame 39 of the printing machine.

The protective grille 1 is fixed vertically in the direction of motion, so that the guiding device 6 is inclined with respect to the protective grille 1 during the movement from the rest position into the feeding position. At the same time, due to the linearly defined direction of motion of the protective grille 1 and the movement of the roller 24 on the inclined rolling surface 25, the guiding device 6 is permitted to pivot during the movement of the protective grille 1 from the rest position into the feeding position.

Figure 9:
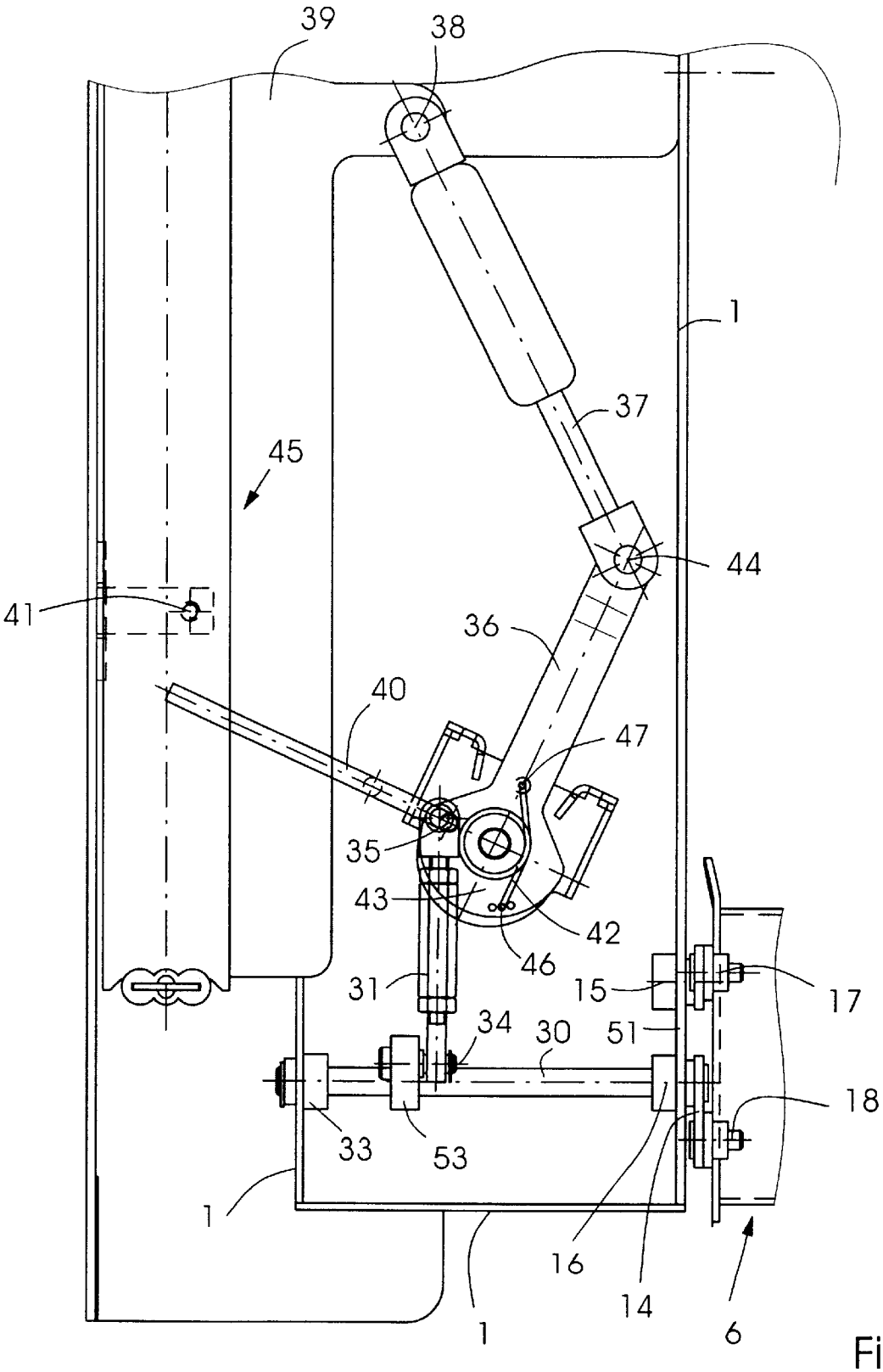
FIG. 9 is a front elevational view of another embodiment of the invention, with a driver or entrainer arm and a pin.

FIG. 9 is a fragmentary diagrammatic view of a printing machine showing a further embodiment of the invention wherein, instead of the roller 24 and the rolling surface 25, a rotatably mounted driver arm 40 and a triggering or releasing pin 41 are provided. The triggering pin 41 is formed on the frame 39 of the printing machine and projects into a path of movement of a driver or entrainer arm 40. The driver arm 40 is firmly connected to a rotating disk 43 at a fixing point 35. The rotating disk 43 is, in turn, connected to a pin lever 53 at a fifth pivot 34, via a coupling rod 31 which is rotatably mounted on the rotating disk 43 at the fixing point 35. The pin lever 53 is, in turn, fastened to a shaft 30, which is rotatably mounted in the protective grille 1 on one side via a first mounting 33. The second end of the shaft 30 is connected via the second pivot 16 to the second lever arm 14, which is fixed to the guiding device 6 at the fourth pivot 18. The second pivot 16 is provided on a side face 51 of the protective grille 1. The guiding device 6 is constructed according to FIGS. 1 to 7.

The rotating disk 43 is connected to a tilting lever 36, which is rotatably mounted via an eighth pivot 44 on a gas-pressure spring 37, the gas-pressure spring 37 being rotatably mounted on the frame 39 of the printing machine at a seventh pivot 38. The rotating disk 43 is mounted so that it can rotate with respect to the tilting lever 36 counter to a biasing force. The biasing force is applied by a restoring spring 42, which is fixed to the tilting lever 36 at a second fixing point 47 and to the rotating disk 43 at a third fixing point 46.

In the position illustrated in FIG. 9, the guiding device 6 is in the rest position. The driver arm 40 extends into the region of the triggering pin 41, so that during an upward movement of the protective grille 1 into the feeding position, the trigger pin 41 forces the driver arm 40 downwardly, the gas-pressure spring 37 pivoting to the lefthand side and coming into contact with a stop face 45. The length of the driver arm 40 is constructed so that it can be moved via the triggering pin 41 only if the rotating disk 43 executes a rotation with respect to the tilting lever 36.

Figure 10:
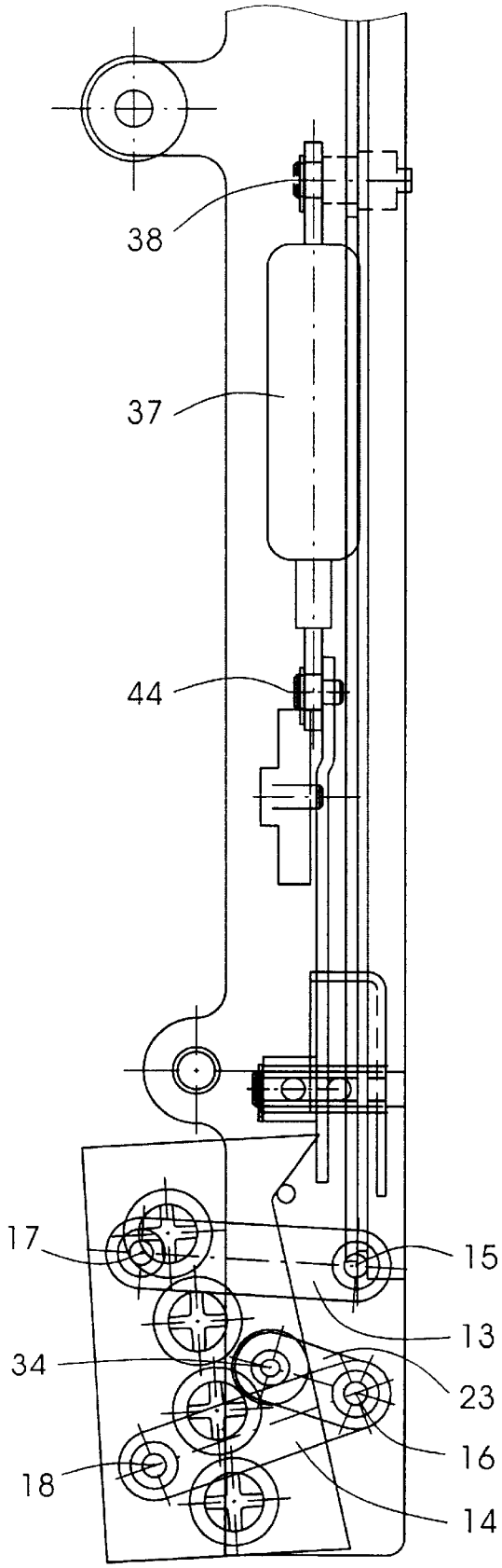
FIG. 10 is a side elevational view of FIG. 9.

FIG. 10 shows the arrangement of FIG. 9 in a diagrammatic side elevational view.

Figure 11:
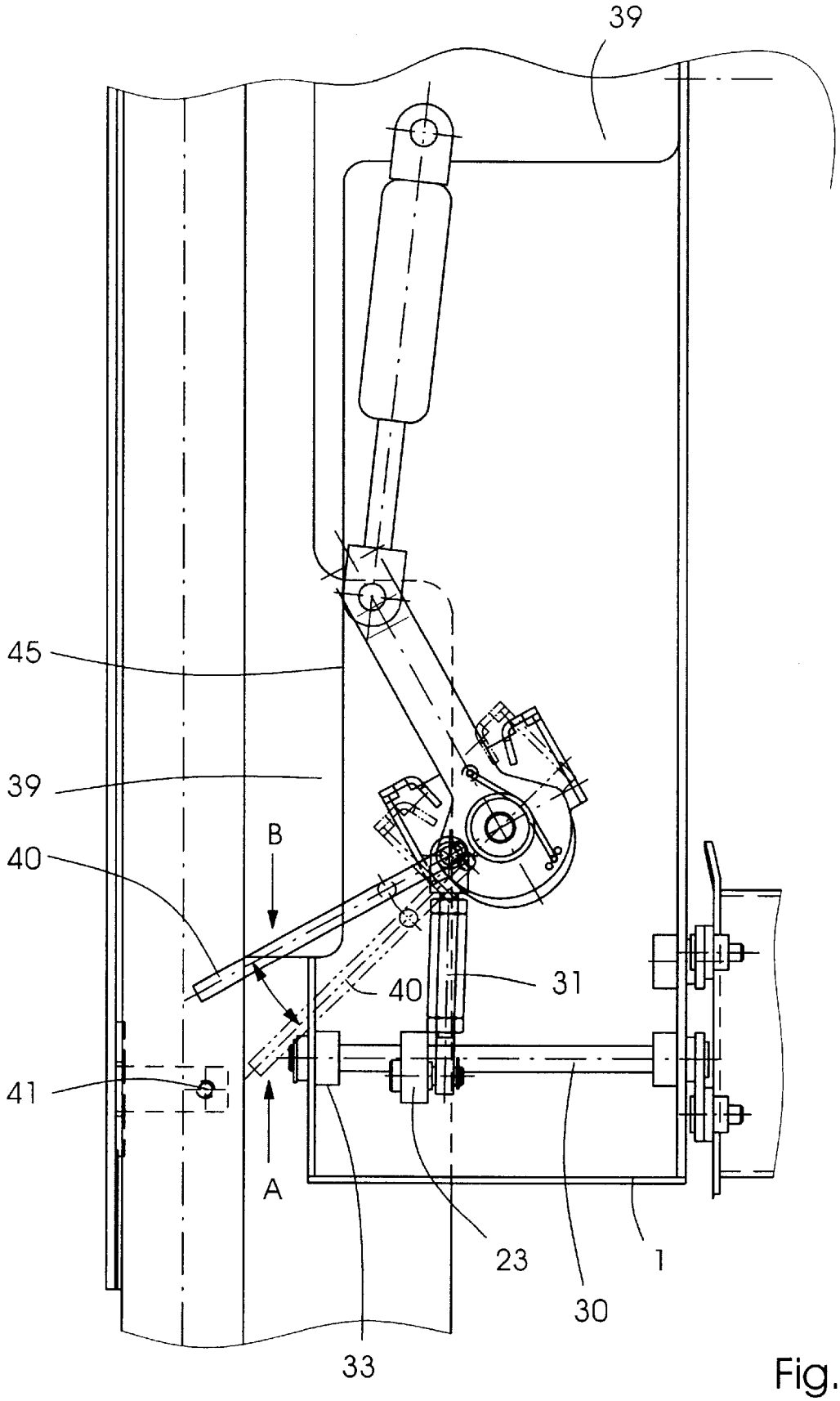
FIG. 11 is a view similar to that of FIG. 9, showing the embodiment of FIG. 9 with the driver arm in the feeding position.

FIG. 11 shows the driver arm 40 in a position A, wherein the driver arm 40 is being moved past the triggering pin 41. This is the case when the protective grille 1 is moved upwardly into the feeding position. In this position, the tilting lever 36 and the gas-pressure spring 37 in the region of the eighth pivot 44 rest on the stop face 45 of the frame 39. Consequently, for a movement of the lever arm 40 past the triggering pin 41, the rotating disk 43 must be rotated with respect to the fixed position of the tilting lever 36, counter to the biasing force of the restoring spring 42.

After the driver arm 40 has been moved past the triggering pin 41, the driver arm 40 springs back into the defined starting position again, the rotating disk 43 also moving back into the predefined starting position with respect to the tilting lever 36. This position is identified by the letter B in FIG. 11. Because of the deflection of the driver arm 40, the shaft 30 has been rotated via the coupling rod 31, and therefore the guiding device 6 has been tilted into the feeding position via the second lever arm 14. To this end, the shaft 30 is permanently connected to the second lever arm 14.

The manner wherein the guiding device 6 of FIGS. 9 to 11 functions corresponds to the manner wherein the guiding device 6 of FIGS. 1 to 8 functions, and is therefore not again illustrated explicitly herein.

We claim:

1. A device for holding and feeding a printing plate to a plate cylinder of a printing machine, comprising a holding device and a member having a supporting surface, the printing plate being disposable by one edge thereof on said supporting surface and being holdable in a predefinable alignment by said holding device, a mounting for movably supporting said holding device on the printing machine for moving said holding device from a rest position into a feeding position, a guide element having at least one guide surface, said guide element being movably mounted on said holding device and being movable with respect to said holding device from a rest position into a feeding position, said guide surface, in said feeding position, defining a feeding direction for feeding a printing plate to the plate cylinder, and a lever device connected to said guide element for operatively connecting said guide element to the printing machine, said guide element being movable automatically from said rest position into said feeding position by movement of said holding device from said rest position into said feeding position.

2. The holding and feeding device according to claim 1, wherein said guide element has two guide surfaces defining a holding space for a printing plate therebetween, said guide element having an axis of rotation disposed at least approximately parallel to an axis of rotation of the plate cylinder, said guide element being rotatable so that an end region of a respective printing plate disposed in said holding space is bent in said feeding direction.

3. The holding and feeding device according to claim 2, wherein one of said two guide surfaces is an outer guide surface formed by rotatably mounted rollers arranged in one plane.

4. The holding and feeding device according to claim 1, wherein said lever device is a roller with a lever arm, said roller being operatively connected to said guide element via said lever arm, said roller being rollable on a rolling surface during said movement of said holding device from said rest position into said feeding position, said rolling surface being formed so that said guide element is movable by said roller into said feeding position, via said lever arm, during said movement of said holding device from said rest position into said feeding position.

5. The holding and feeding device according to claim 4, wherein said rolling surface is an inclined plane with a defined angle of inclination.

6. The holding and feeding device according to claim 1, wherein said supporting surface is formed in a rotatably mounted holding bracket, and including a stop element formed on said guide element, said holding bracket being biased against said stop element, said stop element, in said rest position of said guide element, holding said holding bracket in an operating position wherein said supporting surface blocks said feeding direction, and in said feeding position of said guide element, said stop element releasing said holding bracket, and said holding bracket being moved into an operating position, wherein said supporting surface clears said feeding direction.

7. The holding and feeding device according to claim 6, wherein said supporting surface has an edge elevatable in the direction of said holding space, said edge, during a transition of said holding bracket from said rest position into said operating position, being bringable into contact with a printing plate disposed on said supporting surface, so that the printing plate remains standing on said supporting surface and is not released.

8. The holding and feeding device according to claim 1, wherein said guide surface is an inner guide surface having an upper region inclined in a direction of a second guide surface up to a bending edge.

9. The holding and feeding device according to claim 8, wherein said bending edge is formed as a rotatably mounted roller.

10. The holding and feeding device according to claim 1, wherein said lever device is constructed as a driver arm and a triggering pin, said driver arm being mounted so as to rotate about an axis of rotation on said holding device, and said triggering pin being formed on the printing machine, said driver arm being operatively connected to said guide element, and said driver arm and said triggering pin being arranged so that, during said movement of said holding device from said rest position into said feeding position, said driver arm is rotated by said triggering pin into said feeding position, said guide element being also rotated into said feeding position, and said driver arm being rotated into said rest position by said triggering pin during said movement of said holding device from said feeding position into said rest position, said guide element also being rotated into said rest position.

* * * * *